US006701658B1

(12) United States Patent
Brownell

(10) Patent No.: US 6,701,658 B1
(45) Date of Patent: Mar. 9, 2004

(54) MULTIPLE DEVICE GUN BARREL CLEANING TOOL

(75) Inventor: Frank R. Brownell, Montezuma, IA (US)

(73) Assignee: Brownells, Inc., Montezuma, IA (US)

( * ) Notice: Subject to any disclaimer, the term of this patent is extended or adjusted under 35 U.S.C. 154(b) by 0 days.

(21) Appl. No.: 10/387,102

(22) Filed: Mar. 12, 2003

(51) Int. Cl.[7] ..... F41A 29/00
(52) U.S. Cl. ..... 42/95; 15/104.16
(58) Field of Search ..... 42/95; 15/104.16

(56) References Cited

U.S. PATENT DOCUMENTS 182,352 A * 9/1876 Budd ..... 15/104.19
190,123 A * 5/1877 Budd ..... 15/104.16
210,235 A * 11/1878 Birch ..... 42/95
464,843 A * 12/1891 Bagger ..... 401/9
486,331 A * 11/1892 Garrison ..... 15/104.19
707,913 A * 8/1902 Garrison ..... 15/104.19
864,837 A * 9/1907 Durston ..... 15/104.19
940,985 A * 11/1909 Moore ..... 15/104.19
4,547,924 A * 10/1985 Brygider ..... 15/104.16
4,674,218 A 6/1987 Bottomley ..... 42/95
4,858,360 A 8/1989 Hardin ..... 42/95
4,930,240 A 6/1990 Bice ..... 42/95
5,204,483 A * 4/1993 Tellechea ..... 42/95
5,588,242 A * 12/1996 Hughes ..... 42/95
5,934,000 A * 8/1999 Hayes, Sr. ..... 42/95
6,378,236 B1 4/2002 Solberg et al. ..... 42/95

* cited by examiner

*Primary Examiner*—Michael J. Carone
*Assistant Examiner*—Denise J Buckley
(74) *Attorney, Agent, or Firm*—McKee, Voorhees & Sease, P.L.C.

(57) ABSTRACT

A gun barrel cleaning tool is provided for rifle, shotguns and handguns including a rod to which any number of different cleaning devices may be sequentially interconnected in any desired order as is appropriate for a particular cleaning operation. Typical cleaning devices include brushes, mops and loops.

11 Claims, 3 Drawing Sheets

MULTIPLE DEVICE GUN BARREL CLEANING TOOL

BACKGROUND OF THE INVENTION

The barrels of rifle shotguns and handguns require periodic cleaning by manual or powered operation of a tool including a rod having a single cleaning device mounted thereon. Typically, a number of different cleaning devices will be alternately mounted on the rod and then inserted into the barrel of the gun for performing the desired cleaning action. Included among these cleaning devices are brushes, mops and loops. The different brushes may be made of brass, bronze, stainless steel, nylon, felt or any combination of these materials. The brushes may include cores made of brass, stainless steel, steel or nylon. The mops may be made of cotton, wool or felt.

It is thus seen that the cleaning of a gun barrel involves a wide choice of cleaning devices and depending on choices made the sequential use of a number of cleaning devices may involve a considerable amount of time. What is needed is a faster way to clean the barrel of a gun utilizing the appropriate combination of cleaning devices.

BRIEF SUMMARY OF THE INVENTION

A manually or power operated handle is connected to a rod in turn connected to a first cleaning device having a connector at its outer end for connection to a second cleaning device which may also have a connector at its outer end for connection to a third cleaning device. The number and type of cleaning devices used at any one time will vary according to the particular circumstances including type of gun being cleaned and the amount of cleaning required.

Each of the cleaning devices will have male and female connectors at opposite ends thus allowing any combination of cleaning devices to be connected together in end to end relationship in whatever order is desired.

DETAILED DESCRIPTION OF THE PREFERRED EMBODIMENT

Figure 3:
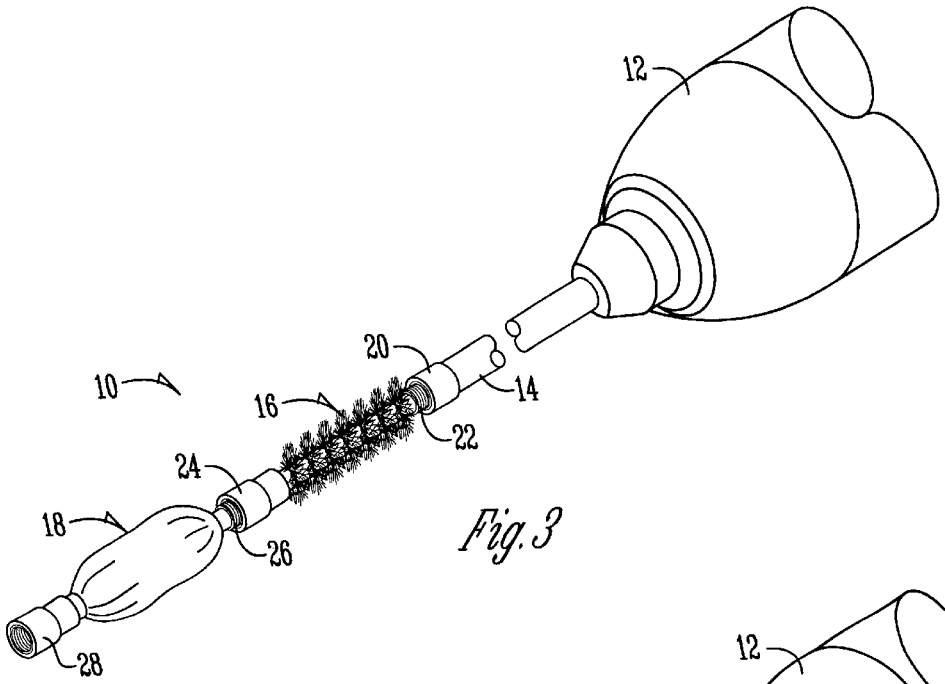
FIG. 3 is a fragmentary perspective view of the gun barrel cleaning device in an assembled condition.
Figure 4:
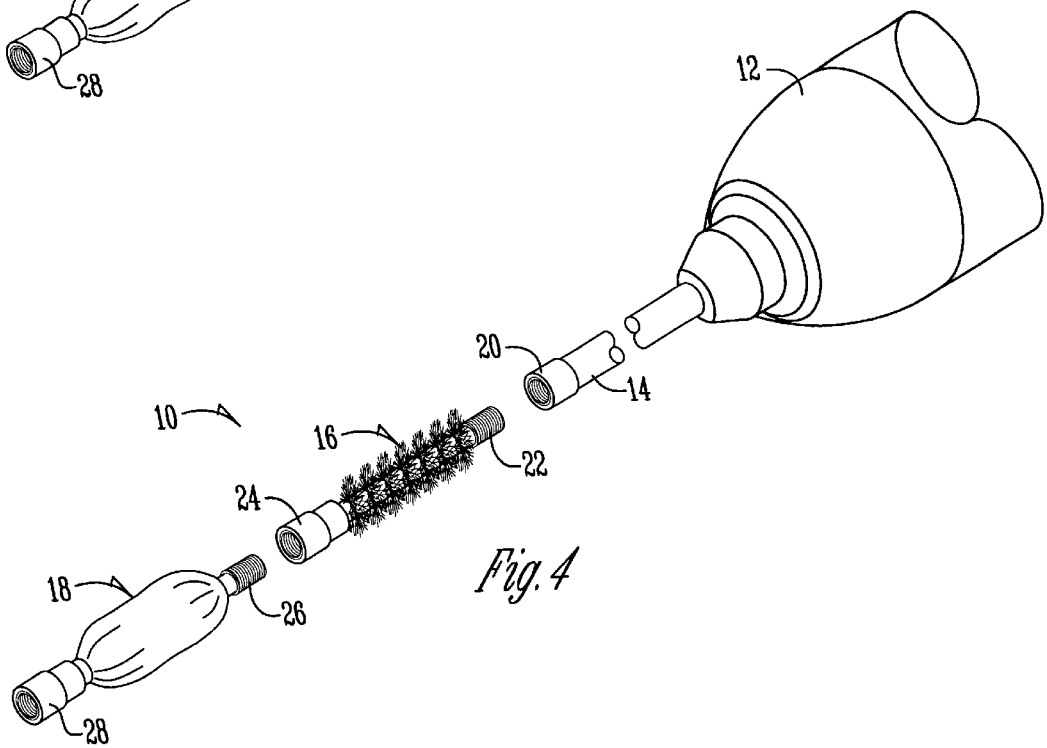
FIG. 4 is an exploded perspective view similar to FIG. 3 but showing the gun barrel cleaning device disassembled.

The gun barrel cleaning device of this invention is referred to generally in FIG. 3 by the reference numeral 10 and is seen to include a manually operated handle 12 connected to a rod 14 in turn connected to a brush 16 connected to a mop 18.

Figure 5:
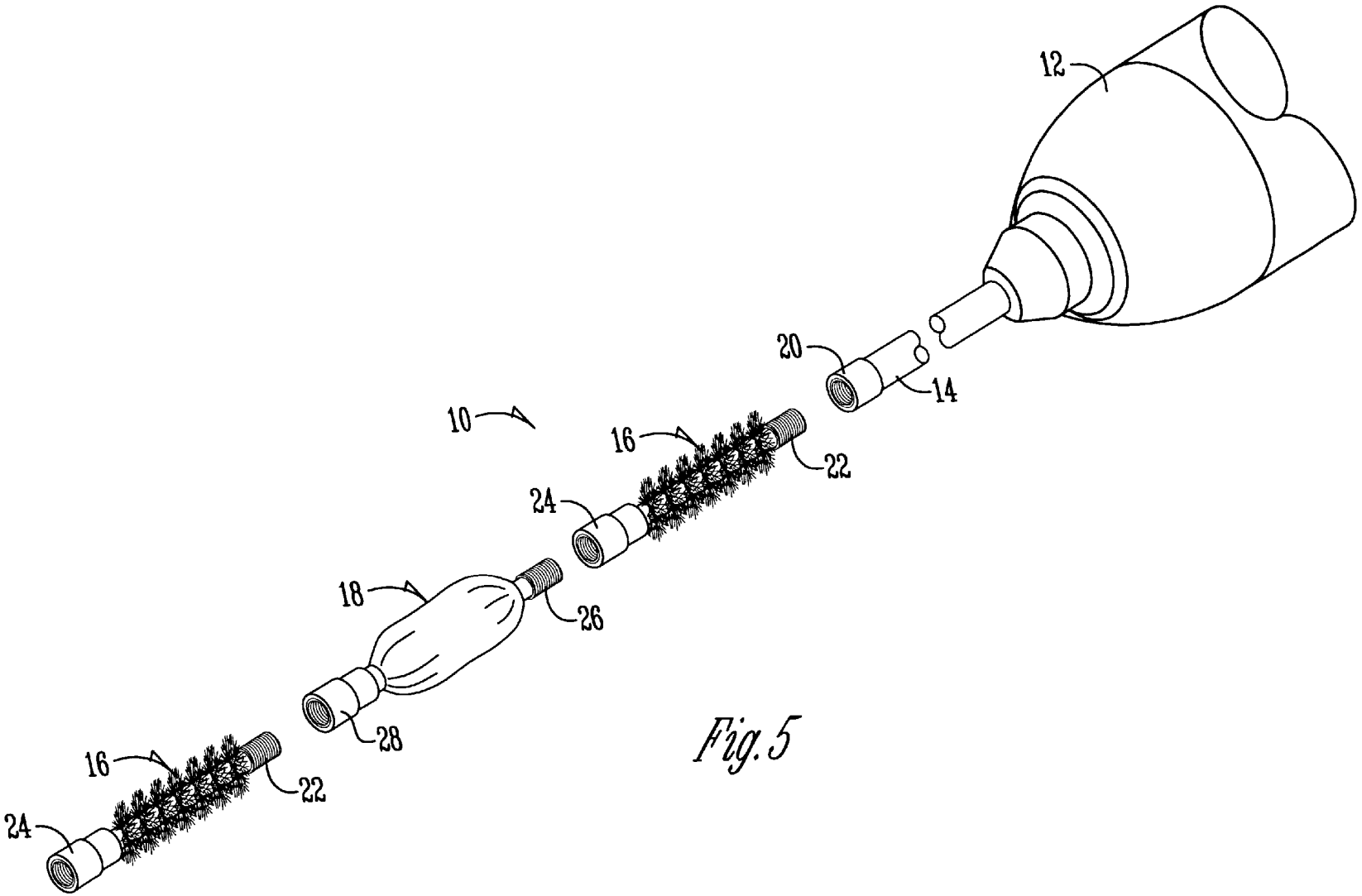
FIG. 5 is a view similar to FIG. 4 but showing three cleaning devices adapted to be interconnected for use during a single cleaning operation.

The rod 14 includes a female threaded connector 20 connecting it to a threaded male connector 22 on the inner end of brush 16. The otter end of the brush 16 includes a female threaded connector 24 connected to a male threaded connector 26 on the mop 18. The outer end of the mop 18 includes a threaded female connector 28 which is adapted to be connected to a third cleaning device such as another brush 16 as seen in FIG. 5 having a male connector 20 on its inner end and a female connector 24 on the outer end.

In use, the cleaning device 10 is inserted into the barrel 36 of a rifle or shotgun 38. The brush 16 and mop 18 are shown positioned in the firing chamber 40 of the gun 38. Rotational and reciprocal operation of the cleaning tool 10 is initiated through the handle 12.

Figure 1:
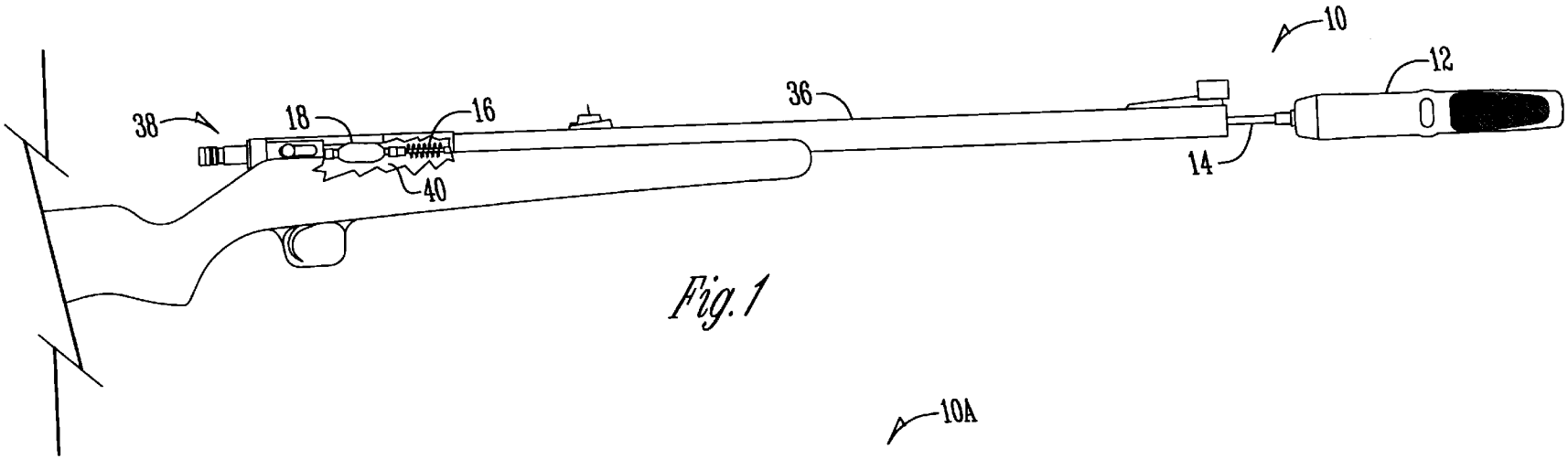
FIG. 1 is a side elevational view of a rifle or shotgun with the barrel cleaning device of this invention inserted therein and including a brush and mop.
Figure 2:
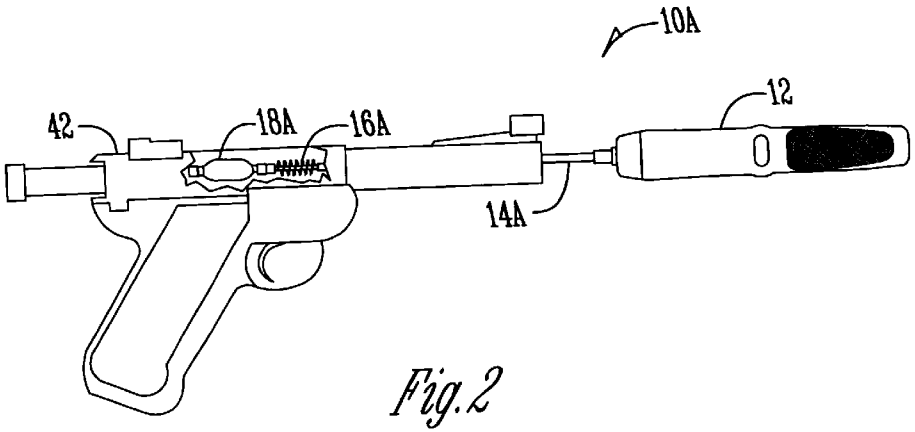
FIG. 2 is a view similar to FIG. 1 but showing the gun barrel cleaning device being used on a hand gun.

In FIG. 2 a gun barrel cleaning tool 10A is shown appropriately sized to clean a pistol 42 wherein a shorter rod 14A is provided connected to a caliber specific brush 16A in turn connected to a caliber specific mop 18A.

It is thus seen that the time required to clean all gun barrels will be substantially reduced while allowing for the simultaneous operation of a wide variety and number of cleaning devices as selected by the gun owner.

What is claimed is:

1. A gun barrel cleaning tool comprising a rod having one end and a connector at its opposite end, a first barrel cleaning device having connectors at opposite ends with one connector end being connected to the connector on said rod, a second barrel cleaning device having a connector at one end with said one end being connected to the other connector on said first barrel cleaning device, thereby providing a series of barrel cleaning devices in end to end relationship for simultaneous use in cleaning the barrel of a gun.

2. The gun barrel cleaning tool of claim 1 wherein said first barrel cleaning device is a brush and said second barrel cleaning device is a mop.

3. The gun barrel cleaning tool of claim 1 wherein said connector on the opposite end of said rod is a female connector and said one connector on said first barrel cleaning device is a male connector.

4. The gun barrel cleaning tool of claim 3 wherein said other connector on said first barrel cleaning device is a female connector and the connector on said one end of said second barrel cleaning device is a male connector.

5. The gun barrel cleaning tool of claim 1 wherein said second barrel cleaning device includes a connector at its other end.

6. The gun barrel cleaning tool of claim 5 and a third barrel cleaning device includes a connector at one end connected to said other connector on said second barrel cleaning device.

7. The gun barrel cleaning tool of claim 1 wherein the connectors interconnecting said first and second barrel cleaning devices are male and female connectors.

8. The gun barrel cleaning tool of claim 1 wherein said first and second barrel cleaning devices include a mop and a brush.

9. The gun barrel cleaning tool of claim 6 wherein each of said first, second and third barrel cleaning devices is either a mop or a brush.

10. The gun barrel cleaning tool of claim 6 wherein said connectors on each of said first, second and third cleaning devices included male and female connectors at opposite ends.

11. The gun barrel cleaning tool of claim 1 wherein a handle is connected to said one end of said rod.

* * * * *